United States Patent [19]

Engel et al.

[11] 4,068,056

[45] Jan. 10, 1978

[54] AMINATED POLYMERIC ADDITIVES FOR FUEL AND LUBRICANTS

[75] Inventors: Lawrence J. Engel, Green Brook; John B. Gardiner, Mountainside, both of N.J.

[73] Assignee: Exxon Research and Engineering Company, Linden, N.J.

[21] Appl. No.: 555,398

[22] Filed: Mar. 5, 1975

[51] Int. Cl.[2] ..... C10M 1/32

[52] U.S. Cl. ..... 526/49; 252/51.5 A; 252/55; 526/19; 526/58

[58] Field of Search ..... 252/51.5 A, 51.5 R, 252/55; 260/80.3 N; 526/19, 49, 58

[56] References Cited

U.S. PATENT DOCUMENTS

| | | | |
|---|---|---|---|
| 3,121,690 | 2/1964 | Berger et al. | 252/55 X |
| 3,388,067 | 6/1968 | Takashima et al. | 252/55 |
| 3,404,092 | 10/1968 | Jacobson et al. | 252/51.5 R |
| 3,445,387 | 5/1969 | Liston | 252/51.5 R X |
| 3,576,742 | 4/1971 | Honnen et al. | 252/51.5 R |
| 3,756,954 | 9/1974 | Abbott et al. | 252/55 |
| 3,769,216 | 10/1973 | Gordon et al. | 252/51.5 R |
| 3,785,980 | 1/1974 | Wilgus | 252/51.5 A |
| 3,864,268 | 2/1975 | Culbertson | 252/51.5 R |
| 3,931,024 | 1/1976 | Hu | 252/51.5 R |

*Primary Examiner*—Delbert E. Gantz
*Assistant Examiner*—Andrew H. Metz
*Attorney, Agent, or Firm*—Roland A. Dexter

[57] ABSTRACT

Aminated polymers, resulting from the reaction of a hydrocarbon polymer with an oxygen-containing gas and an amine compound at elevated temperatures of from about 130° C. to about 300° C. provide a multifunctional additive for lubricants and hydrocarbon fuels. This reaction can be carried out if desired in an oil solution. The resulting aminated polymers are useful as sludge dispersants for fuel lubricants. When the aminated polymers have a high molecular weight, they are also useful as viscosity-index improvers with dispersant and/or pour point depressant activity.

4 Claims, No Drawings

AMINATED POLYMERIC ADDITIVES FOR FUEL AND LUBRICANTS

BACKGROUND OF THE INVENTION

1. Field of the Invention

This invention relates to polymeric dispersant additives for lubricants and hydrocarbon fuels. When of higher molecular weight, the additives are also useful as viscosity index improvers for lubricants.

More particularly, this invention relates to hydrocarbon polymers such as tertiary hydrogen-containing or alpha olefin polymers and, in particularly, ethylene copolymers having a degree of crystallinity of less than about 25 weight percent as determined by X-ray or differential thermal analyses and comprising from about 2 to 98 parts by weight of ethylene and one or more $C_3$ to $C_{28}$ alpha olefins, usually propylene, which have been reacted with an oxygen-containing gas and an amine compound at an elevated temperature of at least about 130° C. to form an aminated polymeric reaction product.

2. Description of the Prior Art

A variety of polymeric materials which incorporate nitrogen have been described in U.S. and foreign patents as dispersants for fuels and lubricants, and as viscosity index improvers for lubricants. For example:

U.S. Pat. No. 3,404,091 grafts polar monomers, such as acrylonitrile onto hydroperoxidized copolymers of ethylene and propylene.

U.S. Pat. No. 3,404,092 reacts hydroxylated ethylene-propylene copolymers with isocyanates.

U.S. Pat. No. 3,687,849 grafts various unsaturated monomers onto a degraded, hydroperoxidized, interpolymer of ethylene and propylene.

U.S. Pat. No. 3,769,216 shows an atactic (i.e., non-crystalline) copolymer of ethylene and propylene containing from 45 to 65 mole percent of ethylene, mechanically degraded in the presence of oxygen, followed by reaction with a polyamine.

U.S. Pat. No. 3,785,980 discloses the reaction product of an amine with a hydroperoxidized atactic copolymer of ethylene and propylene containing from 45 to 65 mole percent of ethylene.

U.S. Pat. No. 3,756,954 discloses the oxidation and degradation of interpolymers and in particular ethylene and propylene copolymers by heating them above 100° C. with an oxygen-containing gas, usually air in the presence of an aliphatic amine which amine serves as a color stabilizer under the conditions of the reaction and is present in an amount of from about 1 to 5 percent based upon the weight of the polymer being degraded.

British Pat. No. 1,172,818 describes the preparation of lube oil additives by the condensation of an amine with an oxidized, e.g., ozonized, polymer.

SUMMARY OF THE INVENTION

Of the above-noted prior art, U.S. Pat. No. 3,756,954 appears to be the most pertinent. In contrast to said patent, wherein the aliphatic amine is present in small amounts to inhibit the destructive degradation of the polymer undergoing oxidation, we have found that we can make satisfactory products using a lower amine content whereby amination of the polymer is achieved. Thus, we have provided a process for the production of an oil-soluble sludge dispersing, viscosity index improving additive for hydrocarbon fuels and lubricants which comprises reacting a hydrocarbon polymer with an oxygen-containing gas and a hydrocarbyl polyamine at an elevated temperature of at least about 130° C. e.g. from about 100° C. to about 300° C. This hydrocarbon polymer is preferably a tertiary hydrogen-containing or alpha olefin polymer and, optimally a copolymer of ethylene and one or more of $C_3$ to $C_{28}$ alpha olefins, said copolymer prior to an oxidation/amination being characterized by: an ethylene content in the range of about 2 to 98 parts by weight; a degree of crystallinity or less than about 25 weight percent as determined by X-ray and differential scanning calorimetry; a weight average molecular weight ($\overline{M}_w$) in the range of about 2000 to 800,000; a number average molecular weight ($\overline{M}_n$) in the range of about 700 to 250,000 and a range of molecular weight as measured by the ratio of $\overline{M}_w/\overline{M}_n$ of less than about 8. The reaction is continued to incorporate from about 0.001 to about 25 weight percent nitrogen in the aminated polymer. The desired nitrogen content is commensurate with the particular application for which the aminated polymeric additive is tailored; as a dispersant, the nitrogen content ranges from about 0.05 to 25 weight percent (preferably from about 0.1 to 12 wt. %) of the total weight of the polymeric additive; and, as a pour depressant, the nitrogen content ranges from about 0.001 to 5.0 wt. %.

DESCRIPTION OF PREFERRED EMBODIMENTS

I. The Polymer

As earlier indicated any hydrocarbon polymer, e.g. polyisobutylene, would be suitable for the use in this process. The preferred polymers are tertiary hydrogen-containing or alpha olefin polymers such as ethylene-propylene copolymers, polyethylene, polypropylene, partially hydrogenated (random or block) polymers of styrene-butadiene or styrene-isoprene and styrene-butadiene-isoprene.

Particularly preferred are those copolymers containing from about 2 to about 98 weight percent of ethylene and one or more $C_3$ to $C_{28}$ alpha olefins, preferably propylene, which have a degree of crystallinity of less than about 25 weight percent as determined by X-ray and differential scanning calorimetry and have a weight average molecular weight ($\overline{M}_w$) in the range of about 2000 to about 800,000 as determined by GPC. These ethylene copolymers may be readily prepared using soluble Ziegler-Natta catalyst compositions, which are well known in the art. For recent reviews of the literature and patent art see: "Polyolefin Elastomers Based on Ethylene and Propylene", by F. P. Baldwin and C. VerStrate in Rubber Chem. & Tech. Vol. 45, No. 3, 709–881, (1972) and "Polymer Chemistry of Synthetic Elastomers," edited by Kennedy and Tornqvist, Interscience, New York, 1969.

Suitable copolymers may be prepared in either batch or continuous reactor systems. In common with all Ziegler-Natta polymerizations, monomers, solvents and catalyst components are dried and freed from moisture, oxygen or other constituents which are known to be harmful to the activity of the catalyst system. The feed tanks, lines and reactors may be protected by blanketing with an inert dry gas such as purified nitrogen. Chain propagation retarders or stoppers, such as hydrogen and anhydrous hydrogen chloride, may be fed continuously or intermittently to the reactor for the purpose of controlling the molecular weight within the desired limits and the degree of crystallinity known to be optimum for the end product.

In addition to ethylene and propylene which are available commercially in a state of purity designated "polymerization grade", other olefins which are useful for the preparation of these copolymers include: 1-butene, 1-pentene, 1-hexene, 1-octene and other long chained alphaolefins. Branched chain alpha-olefins, such as 5-methylpentene-1 and 6-methylheptene-1, may also be utilized.

Media for dissolving or dispersing the catalyst components and copolymer reaction products, and for heat exchange, may be selected from the general group of saturated petroleum hydrocarbons and halogenated hydrocarbons. $C_{12}$ or lower, straight or branched chain hydrocarbons are preferred. However, $C_5$ to $C_9$ saturated alicyclic, or $C_6$ to $C_9$ aromatic hydrocarbons may be used with equal facility. Equally useful are halogenated hydrocarbons having two to six carbon atoms in the molecule. Representative non-limiting examples of solvents, which are also useful for removal of the heat of reaction, include: propane, butane, pentane, hexane, cyclopentane, heptane, cyclohexane, methyl cyclopentane, n-heptane, methyl cyclohexane, isooctane, benzene, toluene, mixed xylenes, sym-dichloroethane, trichloroethane and ortho-dichlorobenzene.

Principal Ziegler-Natta catalysts, useful in the synthesis of suitable copolymers of this invention, are selected from the group of transition metal compounds comprising Groups IVb, Vb and VIb of the Periodic Table of the Elements. Particularly useful are compounds of vanadium and titanium. Most preferred are compounds of vanadium having the general formula $VO_zX_t$, wherein $z$ has a value of 0 or 1, $t$ has a value of 2 to 4 and X is independently selected from the group consisting of halogens having an atomic number equal to or greater than 17 (Cl, Br and I), acetylacetonates, haloacetylacetonates, alkoxides and haloalkoxides. Nonlimiting examples of such catalysts are: $VOCl_3$; $VO(AcAc)_2$; $VOCl_2(OBu)$; $V(AcAc)_3$ and $VOCl_2AcAc$; where Bu is butyl and AcAc is an acetylacetone.

Titanium compounds, which are best used in combination with vanadium compounds, have the general formula $Ti(OR)_4$, wherein R is an acyclic, or alicyclic, monovalent hydrocarbon radical of 1 to 12 carbon atoms.

Most preferred among the principal catalysts are: vanadyl trichloride ($VOCl_3$), and tetrabutyl titanate ($Ti(OBu)_4$) used in combination with $VOCl_3$.

Ziegler-Natta cocatalysts, for use with the above principal catalysts, comprise organometallic reducing compounds from Groups IIa, IIb and IIIa of the Periodic Table of the Elements. Particularly useful are the organoaluminum compounds having the general formula $AlR'_mX'_n$, wherein R' is a monovalent hydrocarbon radical selected from the group consisting of $C_1$ to $C_{12}$ alkyl; $C_6$ to $C_{12}$ alkylaryl and arylalkyl; and $C_5$ to $C_{12}$ cycloalkyl radicals, wherein $m$ is a number from 1 to 3, X' is a halogen having an atomic number equal to or greater than 17, and the sum of $m$ and $n$ is equal to three.

Non-limiting examples of useful cocatalysts are: $Al(Et)_3$; $Al(isoBu)_3$; $EtAl(Cl)_2$; $Et_2AlCl$; and $Et_3Al_2Cl_3$.

The temperature at which the polymerization is conducted can influence the stability of the catalyst species present in the reaction, with a corresponding influence on the rate of polymerization and the molecular weight of the polymer which is formed. Suitable temperatures are in the range of −40° C. to 100° C., preferably 10° C. to 80° C., most preferably about 20° C. to 60° C.

The pressure at which the polymerization is conducted will depend on the solvent, the temperature which is maintained in the reaction milieu and the rate that monomers are fed to the reactor. In the preferred temperature range, a pressure in the range of about 0 to 150 psig has given satisfactory results.

Molecular weight may be regulated by choice of solvent, monomer, principal catalyst concentration, temperature the nature and amount of the cocatalyst, e.g., aluminum alkyl cocatalyst concentration, and whether a chain transfer reagent such as hydrogen is employed.

Polymerization may be effected to produce the high ethylene content copolymers used in the invention. By passing 0.1 to 15, for example 5 parts of ethylene; 0.05 to 10, for example 2.5 parts of higher alpha-olefin, typically propylene; and from 10 to 10,000 parts of hydrogen per million parts of ethylene; into 100 parts of an inert liquid solvent containing (a) from about 0.0017 to 0.017, for example 0.0086 parts of a transition metal principal catalyst, for example $VOCl_3$; and (b) from about 0.0084 to 0.084, for example 0.042 parts of cocatalyst, such as $(C_2H_5)_3Al_2Cl_3$; at a temperature of about 25° C. and a pressure of 60 psig. for a period of time sufficient to effect optimum conversion, for example, 15 minutes to one-half hour.

Since the reactivity of the higher alpha-olefin and rate in which it is incorporated into the copolymer is less than it is for ethylene, it is desirable to feed somewhat more than the theoretical proportions of higher alphaolefin to obtain a copolymer having the desired ethylene content.

Conventional procedures, well known in the art may be used for recovery of the polymer from the reaction mixture leaving the reactor. The polymer "cement" issuing from the reactor may be quenched with a lower alcohol such as methanol or isopropanol. A chelating agent can be added to solubilize the catalyst residues, and the polymer recovered as an aqueous slurry by steam stripping. The resulting wet crumb may be purified by filtration, and then dried at a moderately elevated temperature under vacuum.

II. Oxidation/Amination of Polymer

The mastication or mixing of polymers by mechanical means is old in the art. For the purposes of this invention, the oxidation/amination of the polymer may be done with a single piece of equipment, e.g. a masticator, Banbury mixer, rubber mill extruder, homogenizer, etc., or may be done in stages with any of said equipments. It is preferred to operate in the absence of solvent or fluxing oil so the polymer is readily exposed to air and the amine compound.

Useful equipment includes Banbury mixers and mills having adjustable gaps, which devices may be enclosed in jacketed containers through which a heating medium may be passed such as superatmospheric steam, or heated DOWTHERM ®.

In this regard, the Bramley Beken Blade Mixer has been found to be particularly useful in providing in a single piece of equipment, the desired degree of oxidation/amination. This mixer, which is equipped with a variable speed drive, has two rollers, fitted with helically disposed knives geared so that one roller revolves at one-half the speed of the other. The rollers are journalled in a jacketed reactor having two hemispherical halves in its base, which conform to the radii of the two rollers. Superheated steam, or heated DOWTHERM ® may be circulated through the jacket to provide the desired temperature.

Useful temperatures for oxidation/amination of the polymers are in the range of about 130° C. to 300° C. The time required to achieve satisfactory results will depend on the type of mixing equipment, the temperature of degrading, and particularly the speed of rotation if using a blade mixer as the degrading or masticating device. With the above referenced Bramley Beken Blade Mixer satisfactory amination with the desired reductions in thickening efficiency may be obtained in from about 0.5 to about 12 hours in the temperature range of 130° C. to 300° C.

When oxidation/amination has reached a desired level, as determined by reduction in thickening efficiency (T.E.) as defined below, a fluxing oil may be added to the aminated polymer. Usually enough oil is added to provide a concentration of aminated polymer in the range of about 5 weight percent to about 49 weight percent based on the weight of the total resulting solution.

Thickening efficiency (T.E.) is defined as the ratio of the weight percent of a polyisobutylene (sold by Exxon Chemical Co., New York, N.Y. as PARATONE N ®) having a Staudinger Molecular Weight of 20,000, required to thicken a solvent extracted neutral oil, having a viscosity of 150–105 SUS at 37.8° C., a viscosity index of 105 and an ASTM pour point of 0° F., (Solvent 150 Neutral) to a viscosity of 12.4 centistokes at 98.9° C., to the weight of a test copolymer required to thicken the same oil to the same viscosity at the same temperature.

Another approach is to carry out the reaction as solution oxidation/amination with ordinary stirring or gas mixing. This can be conveniently carried out by heating the polymer as a fluid solution (such polymer in an inert solvent) with oxygen or air and in the presence of the desired amount of the amine of the type to be described hereinafter. A mixture of oxygen and an inert gas such as nitrogen or carbon dioxide may be used. The inert gas then functions of a carrier of oxygen and often provides a convenient means of introducing oxygen into the reaction mixture. The oxygen or air may be introduced by bubbling through the polymer solution. However, it is frequently preferred to merely blow air over the surface of the solution while subjecting it to shearing agitation.

The inert solvent used in preparing the fluid solution of the polymer is preferably a liquid hydrocarbon such as naphtha, hexane, cyclohexane, dodecane, mineral oil, biphenyl, xylene or toluene, a lubricating oil of the solvent neutral type, a white lubricating oil, chlorinated solvents such as dichlorobenzene, isopars, etc. The amount of the solvent is not critical so long as a sufficient amount is used to result in the fluid solution of the polymer so as to facilitate the oxidation/amination reaction. Such a solution usually contains from about 50 to about 95 weight percent of the solvent.

In accordance with the invention the reaction of the oxygen-containing gas with the polymer occurs concurrently with the reaction of the polymer with the amine compound. Sufficient oxygen is supplied to provide for the extent of amination necessary to yield the desired nitrogen contents of the aminated polymeric additives. The amine compounds are described herein immediately hereinafter.

III. Amine Compound

Useful amine compounds for reaction in the oxidation/amination of the polymers include mono- and polyamines of about 2 to 60, e.g., 3 to 20, total carbon atoms and about 1 to 12, e.g., 2 to 6 nitrogen atoms in the molecule, which amines may be hydrocarbyl amines or may be hydrocarbyl amines including other groups, e.g., hydroxy groups, alkoxy groups, amide groups, imidazoline groups, and the like. Preferred amines are aliphatic saturated amines, including those of the general formulae:

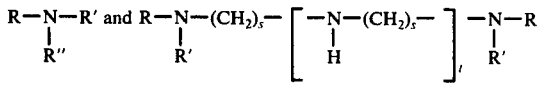

wherein R, R′ and R″ are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$ to $C_{12}$ hydroxy amino alkylene radicals; and $C_1$ to $C_{12}$ alkylamino $C_2$ to $C_6$ alkylene radicals; s is a number of from 2 to 6, preferably 2 to 4; and t is a number of from 0 to 10, preferably 2 to 6.

Non-limiting examples of suitable amine compounds include: 1,2-diaminoethane; 1,3-diaminopropane; 1,4-diaminobutane; 1,6-diaminohexane; diethylene triamine; triethylene tetramine; tetraethylene pentamine; 1,2-propylene diamine; di-(1,2-propylene) triamine; di-(1,3-propylene) triamine; N,N-dimethyl-1,3-diaminopropane; N,N-di-(2-aminoethyl) ethylene diamine; N,N-di-(2-hydroxyethyl)-1,3-propylene diamine; 3-dodecyloxypropylamine; N-dodecyl-1,3-propane diamine; tris hydroxymethyl methylamine, diisopropanol amine, and diethanol amine and mono-, di-, and tri-tallow amines.

Other useful amine compounds include: alicyclic diamines such as 1,4-di-(aminomethyl) cyclohexane, and heterocyclic nitrogen compounds such as imidazolines and N-aminoalkyl piperazines of the general formula:

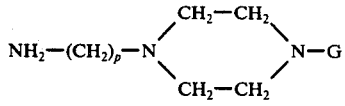

wherein G is independently selected from the group consisting of hydrogen and Ω aminoalkylene radicals of from 1 to 3 carbon atoms; and *p* is an integer of from 1 to 4. Non-limiting examples of such amines include 2-pentadecyl imidazoline; N-(2-aminoethyl) piperazine; N-(3-aminopropyl) piperazine; and N,N′-di-(2-aminoethyl) piperazine.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and isomeric piperazines. Low cost poly(ethyleneamines) compounds having a composition approximating tetraethylene pentamine are available commercially under the trade name "Polyamine H" and Polyamine 400 (PA-400) which is marketed by Jefferson Chemical Co., New York, N.Y. Similar materials may be made by the polymerization of aziridine, 2-methyl aziridine and azetidine.

Still other amines separated by hetero atom chains such as polyethers or sulfides can be used.

The oil-soluble aminated polymeric additives of this invention can be incorporated in lubricating oil compositions, e.g., automotive or diesel crankcase lubricating oil, in concentrations within the range of about 0.01 to 20 weight percent, e.g., 0.1 to 15.0 weight percent, preferably 0.25 to 10.0 weight percent of the total composition. The lubricants to which the aminated products of this invention can be added include not only hydrocarbon oil derived from petroleum, but also include synthetic lubricants such as: alkyl esters of dibasic acids; complex esters made by esterification of monobasic acids, polyglycols, dibasic acids and alcohols; esters of carbonic and phosphoric acids; carboxylic acids of polyglycols; etc.

The aminated polymers may be prepared in a concentrate form, e.g., from about 20 weight percent to about 49 weight percent in oil, e.g., mineral lubricating oil, for ease of handling.

The above concentrates may contain other conventional additives, such as dyes, pour point depressants, antiwear agents, antioxidants, other viscosity-index improvers, dispersants and the like.

This invention will be further understood by reference to the following examples which include preferred embodiments of the instant invention.

EXAMPLE 1

Six pounds of a copolymer of ethylene and propylene containing about 55 weight percent ethylene and having a T.E. of 2.86 were put into a masticator which was 2½ gallon Bramley Beken Blade Mixer, fitted with a 5 H.P. Reeves vari-speed motodrive geared to provide a speed at the mixer of from about 13 to 150 rpm. The masticator was heated with a steam jacket to 345°–368° F. and 8.5 grams (0.305 wt. %) of triethylene tetraamine was added. The fast blade rotated at 52 rpm while the slow blade rotated at 26 rpm for 4.5 hours under ambient air atmosphere. The final material showed a thickening efficiency of 1.46. The polymer was shown by analysis to have 0.071 weight percent nitrogen incorporated into it. The product was blended into solvent 100 Neutral-low pour at 12.5 weight percent to form a concentrate.

EXAMPLES 2–5

Additional aminated polymeric additives according to the invention were prepared in accordance with the procedure and apparatus of Example 1. The results are set forth in the following Table I.

Table I

| | Reaction Conditions | | Amine Compound | | Product | |
|---|---|---|---|---|---|---|
| Example | Time, Hrs. | Temp., ° C. | Name | Amount, Wt.% | T.E. | Wt.% Nitrogen |
| 2 | 4.4 | 171–191 | diethylene triamine | 0.305 | 1.35 | 0.05 |
| 3 | 4.7 | 171–188 | PA-400* | 0.268 | 1.36 | 0.12 |
| 4 | 5.0 | 188 | PA-400* | 0.154 | 1.43 | 0.05 |
| 5 | 4.8 | 174–191 | tetraethylene pentaamine | 0.382 | 1.43 | 0.09 |

*Polyamine 400 (PA-400)

The utility of the aminated polymeric additives of the invention is demonstrated by the following formulations subjected to engine test. A 10W-30 SAE crankcase oil was made up using 9.1 wt. % of the oil concentrate of Example 1, 4 vol. % of an ashless dispersant additive, 1 vol. % of a magnesium containing detergent additive, 0.9 vol. % of a zinc dialkyl dithiophosphate additive, 0.3 vol. % of an overbased phenated dispersant and 0.5 vol. % of an antioxidant, in a mineral lubricating oil. For comparison purposes, a formulation was made up to the same viscosity replacing the oil concentrate of Example 1 with a comparable concentrate of non-nitrogen containing ethylene propylene copolymer sold commercially as a viscosity index improver.

The above formulations were tested in the Sequence V-C engine test, which is described in "Multicylinder Test Sequences for Evaluating Automotive Engine Oils," ASTM Special Technical Publication 315F, page 133ff (1973). The V-C test evaluates the ability of an oil to keep sludge in suspension and prevent the deposition of varnish deposits on pistons, valves, and other engine parts. The test results given below clearly show the superior properties of the oil in which the aminated oxy-degraded copolymer of this invention has been incorporated.

| | MS-VC Test Results | | |
|---|---|---|---|
| | Sludge | Piston Skirt Varnish | Total Varnish |
| Oil with aminated copolymer of Example 1 | 8.3 | 8.1 | 8.0 |
| Oil with commercial additive | 6.4 | 7.0 | 7.3 |
| Passing Criteria for test | 8.5 | 8.0 | 8.0 |

In the above test the ratings are on a scale of 0 to 10, with 0 being an excessive amount of sludge and varnish, while 10 being a completely clean engine.

The amination/oxidation can be conducted at pressures ranging from 0.1 to 20 atmospheres.

For the aminated polymeric additives of higher molecular weight, $\overline{M}_n$, of from about 10,000 to about 500,000 (useful for pour point depressant and/or V.I. improving-dispersant applications) the nitrogen content ranges from about 0.001 to 5 weight percent, preferably 0.01 to 0.5 weight percent; for additives of lower molecular weights $\overline{M}_n$ of less than about 10,000 (useful in dispersant or pour point depressant applications) the nitrogen content ranges broadly from about 0.001 to 25 weight percent, preferably from 0.01 to 8 weight percent.

The process of the invention is readily adjusted to yield reaction products of varying nitrogen content so as to tailor their utility for the several applications. This is accomplished by adjustment of the amount of amine compound present during the amination, e.g. more than about 5 wt. % of amine compound based on the weight of the polymer provides highly useful dispersants whereas less than about 1 wt. % based on the weight of the polymer provides pour point depressants and dispersant-V.I. improving additives.

The invention described herein has broader applications than the dispersancy-sludge inhibition-V.I. improving properties of the reaction products that can be achieved through the incorporation of other moieties that would provide other performance characteristics of lubricating oils such as rust-inhibition, oxidative-stability, etc. Further these moieties can be introduced to modify the physical and chemical properties of the reaction products in non-lubricating oil applications to provide such performance characteristics such as adhesion (e.g. by means of acid functionality), dyeability, water shedding, polymer compatibility, etc. Other applications of the polymer additives are in automatic transmission fluids, gear oils, industrial oils, etc.

It is to be understood that the examples present in the foregoing specification are merely illustrative of this invention and are not intended to limit it in any manner; nor is the invention to be limited by any theory regarding its operability. The scope of the invention is to be determined by the appended claims.

What is claimed is:

1. In a process for aminating a degraded-oxygenated copolymer by reaction with a primary or secondary amine or polyamine to form an oil-soluble sludge dispersing, viscosity-index improving additive for normally liquid hydrocarbon fuels and lubricating oils, the improvement which comprises concurrently reacting a Ziegler-Natta catalyzed polymer with a hydrocarbyl polyamine having from 2 to 60 total carbon atoms and from 2 to 6 nitrogen atoms in the presence of an oxygen-containing gas and at an elevated temperature of from about 130° C. to about 300° C. for from 0.5 to about 12 hours and at a pressure ranging from 0.1 to 20 atmospheres, said polymer being a copolymer of ethylene and one or more $C_3$ to $C_{28}$ alpha-olefins, and characterized by: an ethylene content in the range of about 2 to 98 weight percent; a degree of crystallinity of less than about 25 wt. %; and, a weight average molecular weight of from about 2,000 to 800,000 wherein said improvement provides means for introducing from about 0.01 to 0.8 wt. % nitrogen into said polymer enhancing its dispersancy activity.

2. A process according to claim 1, wherein said amine has the general formula:

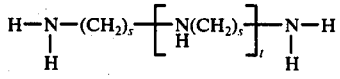

wherein *s* is 2 to 6 and t is 0 to 10 and is present in less than about 1 wt. % based upon the weight of said polymer whereby pour point depressant activity is additionally provided to said additive.

3. A process according to claim 2 wherein said amine is tetraethylene pentamine and said copolymer is a copolymer of ethylene and propylene.

4. Process according to claim 2, wherein said copolymer is a copolymer of ethylene and propylene, and said amine is triethylene tetraamine.

* * * * *